US005278491A

United States Patent [19]

Nitta et al.

[11] Patent Number: 5,278,491

[45] Date of Patent: Jan. 11, 1994

[54] CONSTANT VOLTAGE CIRCUIT

[75] Inventors: Shouzou Nitta, Tokyo; Yasuhiro Sugimoto, Yokohama, both of Japan

[73] Assignee: Kabushiki Kaisha Toshiba, Kawasaki, Japan

[21] Appl. No.: 865,663

[22] Filed: Apr. 7, 1992

Related U.S. Application Data

[63] Continuation of Ser. No. 560,879, Jul. 31, 1990, abandoned.

[30] Foreign Application Priority Data

Aug. 3, 1989 [JP] Japan ..... 1-201851

[51] Int. Cl.[5] ..... G05F 3/26

[52] U.S. Cl. ..... 323/313; 323/315

[58] Field of Search ..... 323/313, 314, 315, 316, 323/907

[56] References Cited

U.S. PATENT DOCUMENTS

| | | | |
|---|---|---|---|
| 3,893,018 | 7/1975 | Marley . | |
| 4,100,477 | 7/1978 | Tam | 323/314 |
| 4,100,478 | 7/1978 | Tam . | |
| 4,176,308 | 11/1979 | Dobkin et al. . | |
| 4,189,671 | 2/1980 | Yuen | 323/314 |
| 4,277,739 | 7/1981 | Priel . | |
| 4,490,670 | 12/1984 | Wong | 323/313 |
| 4,628,248 | 12/1986 | Birrittell et al. . | |
| 4,644,249 | 2/1987 | Chang . | |
| 4,725,770 | 2/1988 | Okutsu et al. . | |
| 4,751,463 | 6/1988 | Higgs et al. | 323/314 |
| 4,810,902 | 3/1989 | Storti et al. . | |

FOREIGN PATENT DOCUMENTS

| | | |
|---|---|---|
| 0288939A1 | 2/1988 | European Pat. Off. . |
| 59-224923 | 12/1984 | Japan . |
| WO85/02472 | 6/1985 | PCT Int'l Appl. . |

OTHER PUBLICATIONS

ISSCC Digest of Technical Papers, pp. 158–159; New Developments in IC Voltage Regulators; R. J. Widlar; Feb. 1970.

IEEE Journal of Solid-State Circuits, vol. SC-19, No. 4; pp. 474–479; A333 ps/800 MHz 7K-Gate Bipolar Macrocell Array Employing 4 Level Metallization; M. Suzuki et al.; Aug. 1984.

IEEE Journal of Solid-State Circuits, vol. SC-20, No. 5; pp. 1025–1031; Design and Application of a 2500--Gate Bipolar Macrocell Array; M. Suzuki et al.; Oct. 1985.

*Primary Examiner*—Steven L. Stephan
*Assistant Examiner*—Ben M. Davidson
*Attorney, Agent, or Firm*—Banner, Birch, McKie & Beckett

[57] ABSTRACT

This invention discloses a constant voltage circuit including a bandgap circuit connected between a ground voltage and a source voltage, a transistor, the collector of which is connected to the collector of a negative feedback transistor for supplying a voltage of a base-emitter path to the other terminal of a resistor having one terminal connected to an output terminal of the bandgap circuit, and the base of which is connected to a voltage source free from variations in source voltage, and a resistor connected between the emitter of the transistor and the source voltage.

12 Claims, 2 Drawing Sheets

CONSTANT VOLTAGE CIRCUIT

This application is a continuation of application Ser. No. 07/560,879, filed Jul. 31, 1990, now abandoned.

BACKGROUND OF THE INVENTION

1. Field of the Invention

The present invention relates to a constant voltage circuit used in a bias circuit such as an ECL (emitter-coupled logic) gate array and, more particularly, to a bandgap type constant voltage circuit.

2. Description of the Related Art

FIG. 1 shows a conventional Widlar type bandgap circuit 30 used in a constant voltage circuit. In the bandgap circuit 30, a collector-emitter path of a first npn transistor Q1, a first resistor R1, a collector-emitter path of a second npn transistor Q2, and a second resistor R2 are connected in series with each other between a ground voltage GND and a negative source voltage $V_{EE}$ in the order named.

A third resistor R3 and a collector-emitter path of a third npn transistor Q3, the collector and base of which are connected to each other, are connected in series with each other between the emitter (output terminal) of the first transistor Q1 and the negative source voltage $V_{EE}$ in the order named.

In addition, a fourth resistor R4 and a collector-emitter path of a fourth npn transistor Q4 are connected in series with each other between the ground voltage GND and the negative source voltage $V_{EE}$ in the order named. The collector of the fourth npn transistor Q4 is connected to the base of the first npn transistor Q1, and the base of the fourth npn transistor Q4 is connected to the collector of the second npn transistor Q2. The collector and base of the third npn transistor Q3 are connected to the base of the second transistor Q2.

In the above-described bandgap circuit 30, a difference $\Delta V_{BE}$ between a voltage of a base-emitter path of the transistor Q3 and a voltage of a base-emitter path of the transistor Q2 appear across the resistor R2. A voltage difference $\Delta V_{BE}$ is multiplied with R1/R2, and the product appears across the resistor R1. The sum of the voltage $\Delta V_{BE} \cdot R1/R2$ across the resistor R1 and a voltage of a base-emitter path of the transistor Q4 $\Delta V_{BE4}$, that is, $$(\Delta V_{BE} \cdot R1/R2) + V_{BE4} \quad (1)$$

is an output voltage $V_{ref}$. Since the first term of equation (1) has a positive temperature coefficient, and the second term has a negative temperature coefficient, by adjusting the value of the resistor R1, a constant voltage output having a temperature coefficient of zero can be obtained. The value of the output voltage $V_{ref}$ with respect to the negative source voltage $V_{EE}$ is stabilized. When the output current increases, a current flowing in the resistor R1 decreases. The base current of the transistor Q4 is decreased by the decrease in current flowing in the resistor R1. Then, the collector current of the transistor Q4 decreases. When the collector current of the transistor Q4 decreases, the base current of the transistor Q1 increases.

In the bandgap circuit 30 described above, however, the negative feedback function by the transistor Q4 against variations in negative source voltage $V_{EE}$ is not always sufficient, so that variations in output voltage $V_{ref}$ do not sufficiently follow those in negative source voltage $V_{EE}$. Therefore, the difference between the output voltage $V_{ref}$ and the negative source voltage $V_{EE}$ is not kept constant, so that the output current flowing into the load side unexpectedly varies.

As described above, in the conventional bandgap circuit, a constant voltage output can be obtained against variations in temperature. The negative feedback function by the transistor Q4 is, however, not always sufficient against the variations in negative source voltage $V_{EE}$. Therefore, the variations in output voltage $V_{ref}$ do not sufficiently follow those in negative source voltage $V_{EE}$, the difference between the output voltage $V_{ref}$ and the negative source voltage $V_{EE}$ is not kept constant, and the output current flowing into the load side unexpectedly varies, resulting in inconvenience.

SUMMARY OF THE INVENTION

It is an object of the present invention to provide a constant voltage circuit wherein an output voltage perfectly follows variations in source voltage and a difference between an output voltage and a source voltage is stabilized.

A constant voltage circuit of the present invention is characterized by comprising a bandgap circuit connected between a ground voltage and a source voltage, a transistor, the collector of which is connected to the collector of a feedback transistor for supplying a voltage of a base-emitter path to the other terminal of a resistor having one terminal connected to an output terminal of the bandgap circuit, and the base of which is connected to a voltage source free from the variations in source voltage, and a resistor connected between the emitter of the transistor and the source voltage.

Since a basic arrangement is a bandgap circuit, a constant voltage output can be obtained against variations in temperature. In addition, by adding a feedback loop, variations in output voltage perfectly follow those in source voltage, so as to keep a difference between the output voltage and the source voltage constant.

DETAILED DESCRIPTION OF THE PREFERRED EMBODIMENTS

An embodiment of the present invention will be described in detail with reference to the accompanying drawings hereinafter.

Figure 1:
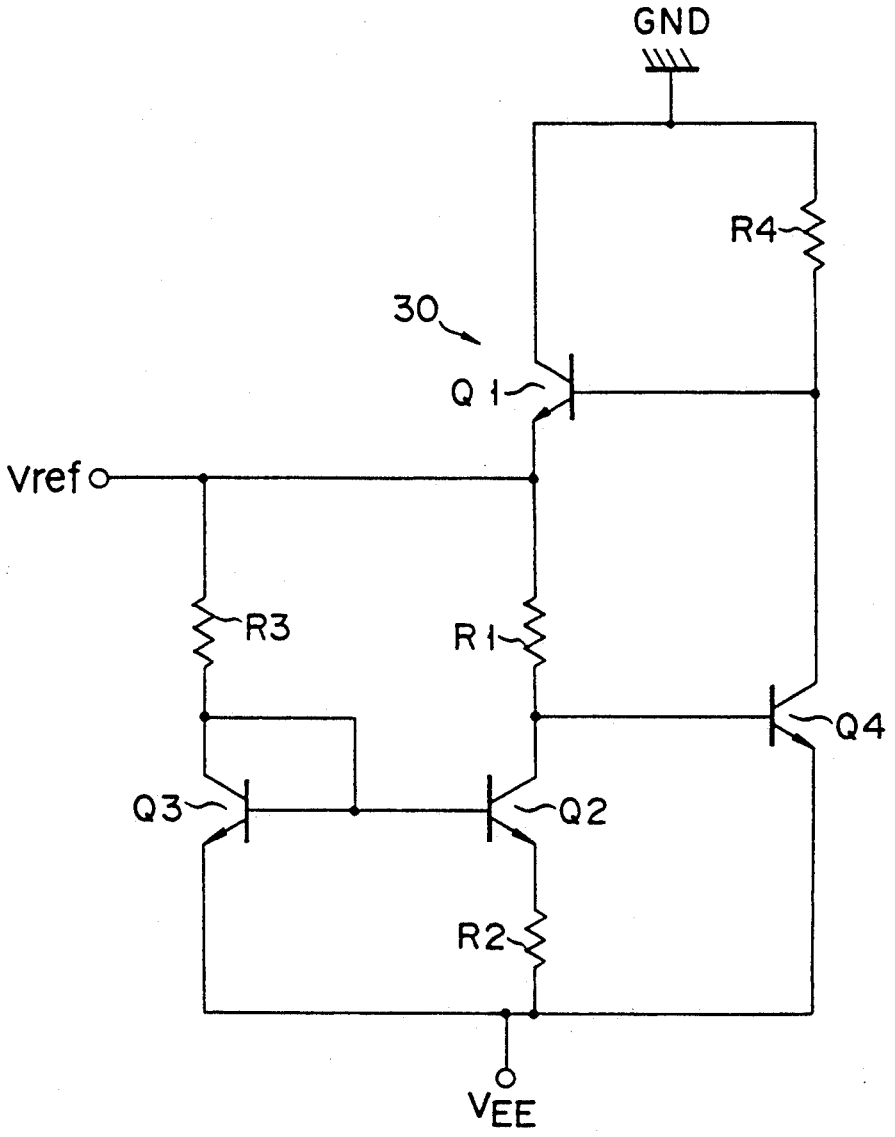
FIG. 1 PRIOR ART
FIG. 1 is a circuit diagram showing a conventional Widler type bandgap circuit used in a constant voltage circuit.
Figure 2:
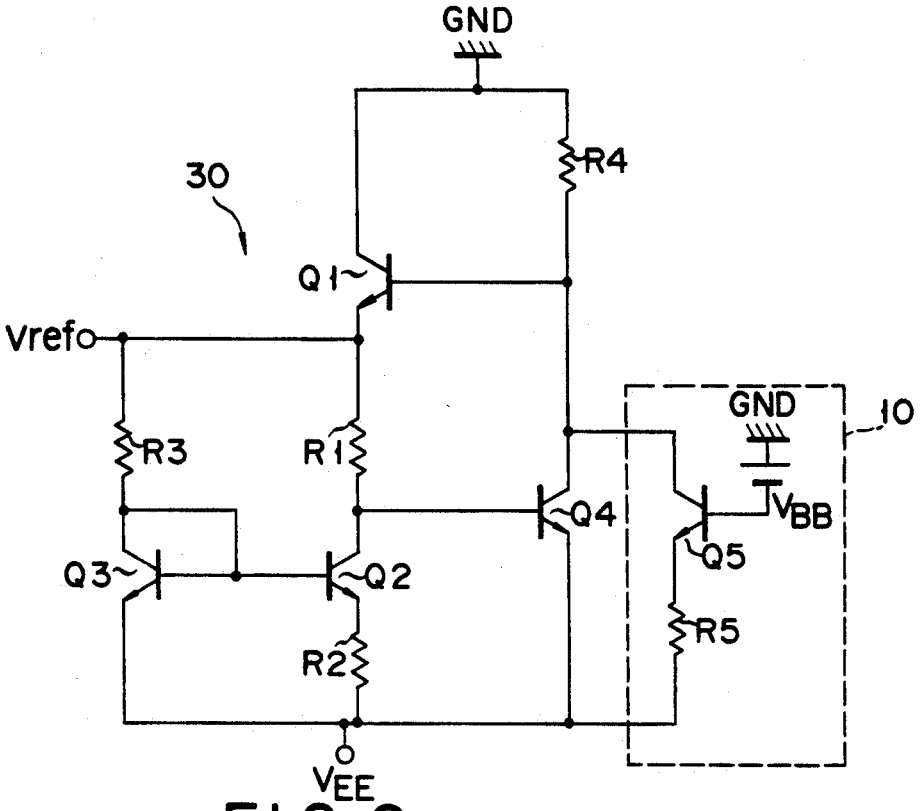
FIG. 2 is a circuit diagram showing a constant voltage circuit according to the present invention used in a bias circuit of an ECL gate array.

FIG. 2 shows a constant voltage circuit used in a bias circuit of an ECL gate array. The constant voltage circuit is different from the conventional bandgap circuit 30 described above with reference to FIG. 1 in additionally comprising a feedback loop 10. Therefore, the same reference numerals as in FIG. 1 denote the same or corresponding parts in FIG. 2, and its explanation will be omitted.

The feedback loop 10 is, for example, as shown in FIG. 2, constituted by a fifth npn transistor Q5, the collector of which is connected to the collector of a transistor Q4, and a fifth resistor R5 connected between the emitter of the fifth npn transistor Q5 and a negative source voltage $V_{EE}$. The base of the fifth npn transistor Q5 is connected to a stabilized voltage source $V_{BB}$ free from variations in negative source voltage $V_{EE}$.

An operation of the above-described constant voltage circuit is essentially the same as the operation of the conventional bandgap circuit 30 described above with reference to FIG. 1. By adding the feedback loop 10, however, the operation which will be described later can be performed. That is, when, for example, the negative source voltage $V_{EE}$ becomes more negative with respect to GND, an ON current of the transistor Q5 increases and a larger amount of current is pulled through a resistor R4. As a result, the base voltage of Q1 and, hence, the emitter voltage decrease, so that an output voltage $V_{ref}$ decreases. In contrast, when the negative source voltage $V_{EE}$ becomes more positive with respect to GND, the ON current of the transistor Q5 decreases, a smaller amount of current is pulled up through the resistor R4. As a result, the base voltage of the transistor Q1 and, hence, its emitter voltage increase, so that the output voltage $V_{ref}$ increases. As described above, variations in output voltage $V_{ref}$ perfectly follow those in negative source voltage $V_{EE}$. Therefore, a difference between the output voltage $V_{ref}$ and the negative source voltage is kept constant.

Figure 3:
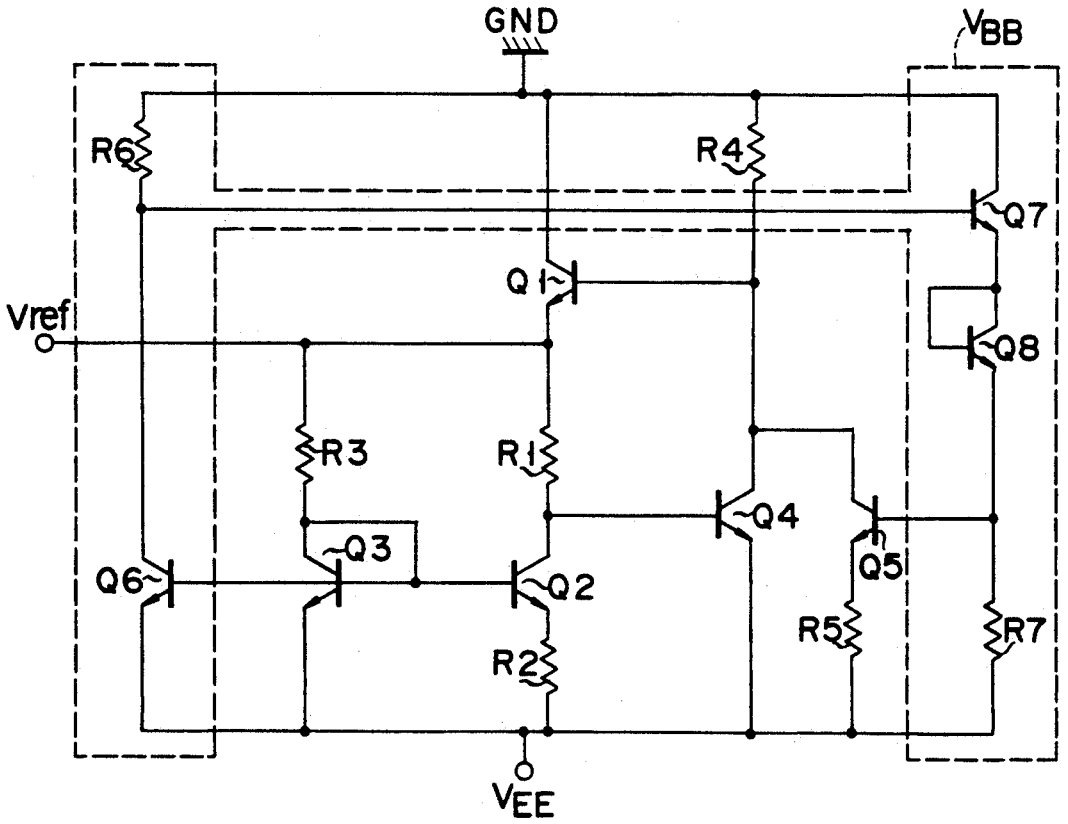
FIG. 3 is a circuit diagram showing a practical arrangement of a voltage source in FIG. 2.

FIG. 3 is a practical circuit arrangement of the voltage source $V_{BB}$ in FIG. 2. The same reference numerals as in FIG. 2 denote the same parts in FIG. 3.

The voltage source $V_{BB}$ is arranged as shown in FIG. 3. A sixth resistor R6 and a collector-emitter path of a sixth npn transistor Q6 are connected in series with each other between the ground voltage GND and the negative source voltage $V_{EE}$ in the order named. The sixth resistor R6 and the sixth npn transistor Q6 constitute a constant voltage generating circuit. Note that, the sixth npn transistor Q6 serves as a constant current source, and the sixth resistor R6 is arranged so as to cause a negative constant voltage in reference to ground voltage GND. A collector-emitter path of a seventh npn transistor Q7, a collector-emitter path of a eighth npn transistor Q8, the collector and the base of which are connected to each other, and a seventh resistor R7 are connected in series with each other between the ground voltage GND and the negative source voltage $V_{EE}$ in the order named. The seventh npn transistor Q7 and the eighth npn transistor Q8 are arranged so as to cause a constant voltage generated by the sixth resistor R6 and the sixth transistor Q6 to drop by a predetermined voltage.

The base of the sixth npn transistor Q6 is connected to the bases of a second npn transistor Q2 and a third npn transistor Q3. The base of the seventh npn transistor Q7 is connected to the collector of the sixth npn transistor Q6. The emitter of the eighth npn transistor Q8 is connected to the base of a fifth npn transistor Q5.

In the constant voltage circuit shown in FIG. 3, a constant current flows through the transistor Q6 for constant current source so that a constant voltage is generated at the connecting point of the resistor R6 and the collector of the transistor Q6. A level of the constant voltage is shifted so as to be supplied to the base of the transistor Q5 in a feedback loop. In this case, a constant voltage generated at the connecting point of the resistor R6 and the collector of the transistor Q6 has a predetermined difference in voltage from the ground voltage GND, so as not to be easily affected by the variations in negative source voltage $V_{EE}$. Therefore, feedback by the feedback loop is effectively performed.

Note that, in the above embodiment, the constant voltage circuit connected between the ground voltage GND and the negative source voltage $V_{EE}$ is shown. The present invention is applicable to a constant voltage circuit connected between a positive source voltage and a ground voltage GND. Note that, a plurality of transistors connected in series with each other, base-collector paths of which are connected to each other, can be used instead of the transistor Q8. In addition, one or a plurality of diodes connected in series can be used instead of the transistor Q8.

What is claimed is:

1. A constant voltage circuit comprising:

a first power source node having a first voltage;

a second power source node having a second voltage, the second voltage having a potential which is less than the potential of the first voltage;

a regulated output node;

bandgap regulator circuit means, coupled to the first power source node and the second power source node, for outputting a thermally regulated voltage signal to the regulated output node, the thermally regulated voltage signal compensated for variations in voltage with respect to the second voltage caused by thermal variations; and source voltage variation compensation means, coupled to the bandgap regulator circuit means, the first power source node and the second power source node, for compensating the thermally regulated voltage signal for variations caused by voltage difference variations between the first voltage and the second voltage, the source voltage variation compensation means including, first constant voltage means, coupled between the first power source node, the second power source node and to a third node, for outputting a third voltage signal to the third node, the third voltage signal having a potential which is constant with respect to the potential of the first voltage, a compensation transistor having a collector coupled to the bandgap regulator circuit means, an emitter coupled to the second power source node and a base coupled to the third node.

2. The constant voltage circuit according to claim 1, wherein the bandgap regulator circuit means includes a current mirror coupled between the regulated output node and the second power source node, and coupled to the first constant voltage means.

3. The constant voltage circuit according to claim 1, further comprising voltage level shifting means, coupled between the third node and the base of the compensation transistor, for shifting the voltage level between the third node and the base of the compensation transistor.

4. The constant voltage circuit according to claim 2, further comprising voltage level shifting means, coupled between the third node and the base of the compensation transistor, for shifting the voltage level between the third node and the base of the compensation transistor.

5. A constant voltage circuit comprising:

a first power source node having a first voltage;

a second power source node having a second voltage, the second voltage having a potential which is less than a potential of the first voltage;

a regulated output node;

a band gap regulator circuit means, coupled to the first power source node, the second power source node and the regulated output node, for outputting a thermally regulated voltage signal to the regulated output node, the thermally regulated voltage signal compensated for variations in voltage with respect to the second voltage caused by thermal variations, the band gap regulator circuit means including current mirror means, coupled to the regulated output node and the second power source node, for providing a constant current through a first transistor; and source voltage variation compensation means, coupled to the bandgap regulator circuit means, the first power source node and the second power source node, for compensating the thermally regulated voltage signal for variations caused by voltage difference variations between the first voltage and the second voltage, the source voltage variation compensation means including, first constant voltage means, coupled between the first power supply and the second power supply node, and controlled by the current mirror means of the band gap regulator means, for outputting a third voltage signal which is constant with respect to the first voltage, and a compensation transistor having a collector coupled to the bandgap regulator circuit means, an emitter coupled to the second power source node and a base coupled to the third voltage signal.

6. The constant voltage circuit according to claim 5, the bandgap regulator circuit means comprising:

a thermal compensation circuit coupled between the first and second power supply nodes and the current mirror means; and a series-pass circuit element coupled between the first power supply node and the output node, and to the thermal compensation circuit.

7. The constant voltage circuit according to claim 5, the first constant voltage means comprising:

a first transistor having a collector coupled to the first power supply node through a first resistor, an emitter coupled to the second power supply node and a base coupled to the bandgap regulator circuit means.

8. The constant voltage circuit according to claim 6, wherein the first constant voltage means comprises:

a first transistor having a collector coupled to the first power supply node through a first resistor, an emitter coupled to the second power supply node and a base coupled to the current mirror circuit means.

9. The constant voltage circuit according to claim 5, wherein the source voltage variation compensation means comprises:

a second transistor having a collector coupled to the first power supply node, a base coupled to the first constant voltage means, and an emitter;

level shift circuit means, coupled between the emitter of the second transistor and the source voltage variation compensation means, for providing a predetermined voltage drop between the emitter of the second transistor and the source voltage variation compensation means; and a second resistor coupled to the level shift circuit means and the second power supply node.

10. The constant voltage circuit according to claim 6, wherein the source voltage variation compensation means comprises:

a second transistor having a collector coupled to the first power supply node, a base coupled to the first constant voltage circuit, and an emitter;

level shift circuit means, coupled between the emitter of the second transistor and the source voltage variation compensation means, for providing a predetermined voltage drop between the emitter of the second transistor and the source voltage variation compensation means; and a second resistor coupled to the level shift circuit means and the second power supply node.

11. The constant voltage circuit according to claim 8, wherein the source voltage variation compensation means comprises:

a second transistor having a collector coupled to the first power supply node, a base coupled to the first constant voltage circuit, and an emitter;

level shift circuit means, coupled between the emitter of the second transistor and the source voltage variation compensation means, for providing a predetermined voltage drop between the emitter of the second transistor and the source voltage variation compensation means; and a second resistor coupled to the level shift circuit means and the second power supply node.

12. The constant voltage circuit according to claim 6, wherein the thermal compensation circuit has a negative temperature coefficient.

* * * * *